United States Patent [19]

Vincent et al.

[11] Patent Number: 4,892,804

[45] Date of Patent: Jan. 9, 1990

[54] PHOTOGRAPHIC COLOR DEVELOPING COMPOSITIONS WHICH ARE ESPECIALLY USEFUL WITH HIGH CHLORIDE PHOTOGRAPHIC ELEMENTS

[75] Inventors: Sheridan E. Vincent; Richard W. Berls, both of Rochester, N.Y.

[73] Assignee: Eastman Kodak Company, Rochester, N.Y.

[21] Appl. No.: 233,882

[22] Filed: Aug. 16, 1988

Related U.S. Application Data

[63] Continuation of Ser. No. 822,097, Jan. 24, 1986, abandoned.

[51] Int. Cl.[4] ..... G03C 7/30; G03C 7/00; G03C 7/40

[52] U.S. Cl. ..... 430/380; 430/372; 430/434; 430/435; 430/464; 430/467; 430/484; 430/485; 430/490; 430/491

[58] Field of Search ..... 430/467, 490, 491, 468, 430/372, 357, 442, 484, 435, 430, 492, 249, 250, 450, 460, 463, 444, 380

[56] References Cited

U.S. PATENT DOCUMENTS

| | | | |
|---|---|---|---|
| Re. 30,064 | 8/1979 | Shimamura | 430/490 |
| 2,875,049 | 2/1959 | Kridel | 430/490 |
| 3,462,269 | 8/1969 | Tassone | 430/490 |
| 3,489,566 | 1/1970 | Anselm | 430/380 |
| 3,746,544 | 7/1973 | Heilmann | 430/467 |
| 3,839,045 | 10/1974 | Brown | 430/490 X |
| 3,994,730 | 11/1976 | Frank et al. | 430/467 |
| 4,155,763 | 3/1979 | Hasebe et al. | 96/55 |
| 4,170,478 | 10/1979 | Case et al. | 430/357 |
| 4,252,892 | 2/1981 | Case | 430/490 X |
| 4,264,716 | 4/1981 | Vincent et al. | 430/380 |
| 4,394,440 | 7/1983 | Cappel | 430/468 X |
| 4,414,307 | 11/1983 | Kapecki et al. | 430/467 X |
| 4,482,626 | 11/1984 | Twist et al. | 430/490 X |
| 4,546,068 | 10/1985 | Kuse | 430/491 X |
| 4,565,776 | 1/1986 | Kim et al. | 430/467 |
| 4,745,047 | 5/1988 | Asami et al. | 430/380 |
| 4,774,167 | 9/1988 | Koshimizu et al. | 430/380 |
| 4,797,350 | 1/1989 | Ohbayashi et al. | 430/380 |
| 4,800,153 | 1/1989 | Morimoto et al. | 430/380 |
| 4,801,516 | 1/1989 | Ishikawa et al. | 430/380 |
| 4,835,092 | 5/1989 | Ishikawa et al. | 430/380 |

OTHER PUBLICATIONS

"Control of Microbiological Growth in Black-and-White Photographic Developers", Research Disclosure, Item 19006, Feb., 1980.

Research Disclosure #16480, Dec. 1977, pp. 60–63.

*Primary Examiner*—Paul R. Michl
*Assistant Examiner*—Patrick Doody
*Attorney, Agent, or Firm*—Alfred P. Lorenzo

[57] ABSTRACT

Photographic color developing compositions which are especially useful in the processing of high chloride silver halide photographic elements are free, or at least substantially free, of bromides; optionally contain a small amount of sulfite; and comprise (1) a primary aromatic amino color developing agent, (2) an N,N-dialkylhydroxylamine, (3) at least one sequestering agent which functions to sequester iron and (4) at least one sequestering agent which functions to sequester calcium. The developing compositions exhibit excellent stability. They also provide minimal development restraint which permits the use of very short development times, as needed for rapid access processing.

25 Claims, No Drawings

PHOTOGRAPHIC COLOR DEVELOPING COMPOSITIONS WHICH ARE ESPECIALLY USEFUL WITH HIGH CHLORIDE PHOTOGRAPHIC ELEMENTS

CROSS-REFERENCE TO RELATED APPLICATIONS

This is a continuation of application Ser. No. 822,097 filed Jan. 24, 1986 and now abandoned.

FIELD OF THE INVENTION

This invention relates in general to photography and in particular to novel compositions and methods for processing photographic color elements. More specifically, this invention relates to novel photographic color developing compositions and to a novel method of rapid access processing of high chloride photographic elements utilizing such developing compositions.

BACKGROUND OF THE INVENTION

The formation of color photographic images by the image-wise coupling of oxidized primary aromatic amino developing agents with color forming or coupling compounds to form indoaniline. indophenol, and azomethine dyes is well known. In these processes, the subtractive process of color formation is ordinarily used, and the image dyes customarily formed are cyan, magenta, and yellow, the colors that are complementary to the primary colors, red, green, and blue, respectively. Usually phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Nondiffusing couplers are incorporated in photographic emulsion layers. When the dye image formed is to be used in situ; couplers are selected which form non-diffusing dyes. For image transfer color processes, couplers are used which will produce diffusible dyes capable of being mordanted or fixed in the receiving sheet.

Photographic color elements often utilize silver halide emulsions of the high bromide type, including silver bromide, silver bromoiodide and silver chlorobromide emulsions. However, as explained in Atwell, U.S. Pat. No. 4,269,927, issued May 26, 1981, high chloride silver halide photographic elements—that is, elements in which the silver halide grains are at least 80 mole percent silver chloride—possess a number of highly advantageous characteristics. For example, silver chloride possesses less native sensitivity in the visible region of the spectrum than silver bromide, thereby permitting yellow filter layers to be omitted from multicolor photographic elements. Furthermore, high chloride silver halides are more soluble than high bromide silver halides, thereby permitting development to be achieved in shorter times.

Photographic color developing compositions used heretofore, have typically been adapted for use with high bromide silver halide photographic elements.

These conventional developing compositions can be used with high chloride silver halide photographic elements, but, in general, they tend to give less than satisfactory results. For example, they typically contain restraining agents such as potassium bromide, which exert too great a retardation effect on development for satisfactory use with high chloride silver halide elements. Moreover, they typically contain hydroxylamine, or a water-soluble acid salt thereof, which functions as an anti-oxidant and thereby serves to protect the primary aromatic amino color developing agent against oxidation. Use of hydroxylamine, or a water-soluble acid salt thereof, is disadvantageous, however, since it tends to act as a scavenger which reduces oxidized color developing agent before it can react with coupler to form dye. It also acts as a developing agent which competes with the color developing agent unless it is adequately restrained by bromide. In addition to hydroxylamine, or a water-soluble acid salt thereof, developing compositions heretofore used with high bromide silver halide elements often contain substantial concentrations of sulfite to also provide protection against oxidation of the developing agent. The sulfite, which is typically utilized in the form of an alkali metal sulfite or bisulfite, functions to sulfonate oxidized color developing agent and, when used in sufficient concentration, its competition with coupler for oxidized color developing agent seriously affects dye formation.

Included among the numerous patents which describe photographic color developing compositions, of the type typically used with high bromide silver halide elements, are the following:

Kridel, U.S. Pat. No. 2,875,049, issued Feb. 24, 1959.

Tassone, U.S. Pat. No. 3,462,269, issued Aug. 19, 1969.

Anselm, U.S. Pat. No. 3,489,566, issued Jan. 13, 1970.

Heilmann, U.S. Pat. No. 3,746,544, issued July 17, 1073.

Brown, U.S. Pat. No. 3,839,045, issued Oct. 1, 1974.

Frank, U.S. Pat. No. 3,994,730, issued Nov. 30, 1976.

Shimamura et al, U.S. Pat. No. 4,083,723, issued Apr. 11, 1978.

Case et al, U.S. Pat. No. 4,170,478, issued Oct. 9, 1979.

Case, U.S. Pat. No. 4,252,892, issued Feb. 24, 1981.

Vincent et al, U.S. Pat. No. 4,264,716, issued Apr. 28, 1981.

Cappel, U.S. Pat. No. 4,394,440, issued July 19, 1983.

Kapecki et al, U.S. Pat. No. 4,414,307, issued Nov. 8, 1983.

Twist et al, U.S. Pat. No. 4,482,626, issued Nov. 13, 1984.

In light of the above, it is clear that there is a need in the art to provide photographic color developing composition and photographic processes which are especially adapted for use with high chloride silver halide elements if the inherent advantages of such elements are to be most fully realized. It is toward the objective of filling such need that the present invention is directed.

SUMMARY OF THE INVENTION

The novel photographic color developing compositions of this invention are especially useful with high chloride silver halide emulsions. They are free, or at least substantially free, of bromides, since bromides in significant quantities can unduly restrain the development reaction. They are free of sulfite, or contain only a low concentration of sulfite, to minimize competition with the dye-forming reactions. They contain the following ingredients:

(1) a primary aromatic amino color developing agent.

(2) an N,N-dialkylhydroxylamine, (3) at least one sequestering agent which functions to sequester iron, and (4) at least one sequestering agent which functions to sequester calcium.

In a preferred embodiment of the invention, the aforesaid photographic color developing composition is free of benzyl alcohol and is used in a rapid access process for processing high chloride silver halide photographic color elements which employs the steps of color developing, bleach-fixing without washing between the color developing and bleach-fixing steps, and stabilizing without washing between the bleach-fixing and stabilizing steps. Elimination of the benzyl alcohol from the developing composition allows the bleach-fix to be utilized at a lower pH than is otherwise permissible, without the risk of producing leuco cyan dye. The low pH increases the rate of bleach-fix reactions, thereby enabling the use of a short bleach-fix time as is needed for a rapid access process.

DESCRIPTION OF THE PREFERRED EMBODIMENTS

The primary aromatic amino color developing agents that are utilized in the compositions and methods of this invention are well known and widely used in a variety of color photographic processes. They include aminophenols and p-phenylenediamines. They are usually used in the salt form, such as the hydrochloride of sulfate, as the salt form is more stable than the free amine, and are generally employed in concentrations of from about 0.1 to about 20 grams per liter of developing solution and more preferably from about 0.5 to about 10 grams per liter of developing solution.

Examples of aminophenol developing agents include o-aminophenol, p-aminophenol, 5-amino-2-hydroxytoluene, 2-amino-3-hydroxy-toluene. 2-hydroxy-3-amino-1,4-dimethylbenzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride,

4-N,N-diethyl-2-methylphenylenediamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, 4-N,N-diethyl-2,2'-methanesulfonylaminoethylphenylenediamine hydrochloride, and the like.

An especially preferred class of p-phenylenediamine developing agents are those containing at least one alkylsulfonamidoalkyl substitutent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525, and can be represented by the formula:

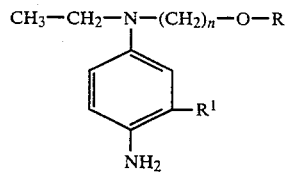

wherein n is an integer having a value of from 2 to 4, R is an alkyl group of from 1 to 4 carbon atoms. and $R_1$ is an alkyl group of from 1 to 4 carbon atoms or an alkoxy group of from 1 to 4 carbon atoms. Illustrative examples of these developing agents include the following compounds:

N-ethyl-N-methoxybutyl-3-methyl-p-phenylenediamine,

N-ethyl-N-ethoxyethyl-3-methyl-p-phenylenediamine

N-ethyl-N-methoxyethyl-3-n-propyl-p-phenylenediamine,

N-ethyl-N-methoxyethyl-3-methoxy-p-phenylenediamine,

N-ethyl-N-butoxyethyl-3-methyl-p-phenylenediamine, and the like.

In addition to the primary aromatic amino color developing agent, the developing compositions of this invention contain an N,N-dialkylhydroxylamine. The N,N-dialkylhydroxylamine can be used in the color developing composition in the form of the free amine, but is more typically employed in the form of a water-soluble acid salt. Typical examples of such salts are sulfates, oxalates, chlorides, phosphates, carbonates, acetates, and the like.

The N,N-dialkylhydroxylamine is preferably of the formula:

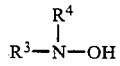

wherein $R_3$ and $R_4$ represent the same or different alkyl groups of 1 to 4 carbon atoms.

Typical examples of N,N-dialkylhydroxylamines include:

N,N-diethylhydroxylamine,

N-ethyl-N-methylhydroxylamine,

N-ethyl-N-propylhydroxylamine,

N,N-dipropylhydroxylamine,

N-methyl-N-butylhydroxylamine, and the like.

Using the N,N-dialkylhydroxylamine in the photographic color developing compositions of this invention provides fully adequate stability against oxidation, without the unwanted development and unwanted reaction with oxidized color developing agent that occurs with the use of unsubstituted hydroxylamines of mono-alkyl substituted hydroxylamines. This is believed to be a result of the two alkyl groups attached to the nitrogen atom serving the block the site at which reaction could otherwise take place.

N,N-dialkylhydroxylamines have been used heretofore in photographic color developing compositions. Thus, for example, they are used in the magenta color developing solutions described in Anselm, U.S. Pat. No. 3,489,566, issued Jan. 13, 1970. However, in these magenta developing solutions, they are employed in combination with an unsubstituted or mono-alkylsubstituted hydroxylamine, and they serve as balancing developing agents.

As described hereinabove, the novel color developing compositions of this invention contain at least one sequestering agent which functions to sequester iron. The preferred sequestering agent for this purpose is an aromatic polyhydroxy compound that forms a complex with ferric ion in alkaline solution in which the molar ratio of the ferric ion to the aromatic polyhydroxy compound is 1 to 3. Preferably, the aromatic polyhydroxy compound is a compound having at least two hydroxy groups in ortho-position in relation to each other on an aromatic ring. Most preferably, it is a compound which has at least two hydroxy groups in ortho-position in relation to each other on an aromatic carbocyclic ring and which is free of exocyclic unsaturation. Included within the broad class of aromatic polyhydroxy compounds which are useful in this invention are, for example, compounds of the benzene series and of the naphthalene series, which can be represented by the formula:

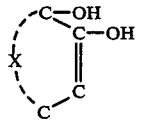

where X represents the carbon atoms necessary to complete the benzene of naphthalene aromatic ring structure. In addition to the hydroxyl substituents, the aromatic ring structure can be substituted with groups such as sulfo radicals, carboxy radicals, or halogen atoms. Typical examples of aromatic polyhydroxy compounds useful in this invention include the following compounds:

pyrocatechol,
4,5-dihydroxy-m-benzene disulfonic acid,
4,5-dihydroxy-m-benzene disulfonic acid disodium salt,
tetrabromopyrocatechol,
pyrogallol,
gallic acid,
methyl gallate,
propyl gallate,
2,3-dihydroxynaphthalene-6-sulfonic acid,
2,3,8-trihydroxynaphthalene-6-sulfonic acid,
and the like.

In a preferred embodiment of this invention, the aromatic polyhydroxy compound is 5,6-dihydroxy-1,2,4-benzenetrisulfonic acid or a 5,6-dihydroxy-1,2,4-benzenetrisulfonate (also known as a catechol trisulfonate or pyrocatechol trisulfonate). These compounds can be represented by the formula:

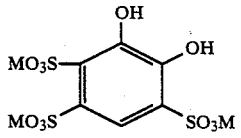

wherein M is hydrogen or a monovalent cation such as sodium or potassium. The most preferred compound of this class is 5,6-dihydroxy-1,2,4-benzenetrisulfonic acid trisodium salt.

The 5,6-dihydroxy-1,2,4-benzenetrisulfonic acid trisodium salt is advantageously employed in photographic color developing compositions in comparison with other similar aromatic polyhydroxy compounds, such as 4,5-dihydroxy-m-benzene disulfonic acid disodium salt in that it is more stable to aerial oxidation and has much less tendency to exhibit adverse sensitometric effects. It can be prepared by oxidation of 4,5-dihydroxy-m-benzene disulfonic acid disodium salt in an alkaline solution containing sulfite. Oxidation can be accomplished by bubbling air through the solution or by reaction with a persulfate.

Aromatic polyhydroxy compounds have been used heretofore in photographic color developing compositions. Thus, for example, they are used in Heilmann, U.S. Pat. No. 3,746,544, issued July 17, 1973, in combination with aminopolycarboxylic acid sequestering agents and in Vincent et al, U.S. Pat. No. 4,264,716, issued Apr. 28, 1981, in combination with aminopolyphosphonic acid sequestering agents.

The primary function of the aromatic polyhydroxy compound in the photographic color developing compositions of this invention is to sequester iron but it can also function to sequester other heavy metals which can also catalyze the auto-oxidation of the N,N-dialkylhydroxylamine. Thus, the aromatic polyhydroxy compound stabilizes the developing composition and enables the N,N-dialkylhydroxylamine to effectively perform its function as an anti-oxidant which protects the primary aromatic amino color developing agent.

As described hereinabove, the novel color developing compositions of this invention contain at least one sequestering agent which functions to sequester calcium and thereby prevent the formation of unwanted precipitates. The preferred sequestering agent for this purpose is an aminopolycarboxylic acid sequestering agent.

The aminopolycarboxylic acid sequestering agents as well known and widely used in photographic processing. Typical examples of the aminopolycarboxylic acid sequestering agents include:

nitrilotriacetic acid, (NTA),
ethylenediaminetetraacetic acid, (EDTA),
1,3-diamino-2-propanol-N,N,N',N'-tetraacetic acid, (DPTA),
diethylenetriaminepentaacetic acid (DTPA),
N,N'-bis(2-hydroxybenzyl) ethylenediamine-N,N'-diacetic acid (HBED),
hydroxyethylethylenediaminetriacetic acid,
cyclohexanediaminotetraacetic acid,
aminomalonic acid,
and the like.

The photographic color developing compositions of this invention are employed in the form of aqueous alkaline working solutions having a pH of about 7 and most typically in the range of from about 9 to about 13. To provide the necessary pH, they contain one or more of the well known and widely used pH buffering agents, such as the alkali metal carbonates of phosphates. Potassium carbonate is especially useful as a pH buffering agent.

As indicated above, the four essential components of the novel photographic color developing compositions of this invention are the primary aromatic amino color developing agent, the N,N-dialkylhydroxylamine, the sequestering agent which functions to sequester iron and the sequestering agent which functions to sequester calcium. The N,N-dialkylhydroxylamine is preferably employed in an amount of from about 1.5 to about 6.0 moles per mole of the developing agent, the sequestering agent which functions to sequester iron is preferably employed in an amount of from about 0.04 to about 0.25 moles per mole of the developing agent, and the sequestering agent which functions to sequester calcium is preferably employed in an amount of from about 0.3 to about 1.7 moles per mole of the developing agent.

A small amount of sulfite can optionally be incorporated in the developing compositions of this invention to provide additional protection against oxidation. In view of the fact that sulfite competes with coupler for oxidized developing agent, it is preferred that the amount of sulfite be very small, for example in the range of from zero to about 0.2 moles per mole of primary aromatic amino color developing agent. The use of a small amount of sulfite is especially desirable when the color developing composition is packaged in the form of a concentrated solution, since such concentrates are especially susceptible to oxidation.

A further ingredient which can optionally be included in the color developing composition is an alkanolamine. The alkanolamines are primarily useful in providing additional protection against oxidation. As described in Case et al, U.S. Pat. No. 4,170,478, issued Oct. 9, 1979, preferred alkanolamines for use in photographic color developing compositions are compounds of the formula:

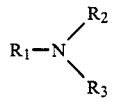

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

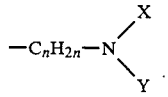

group wherein n is an integer of from 1 to 6 and each of X and Y is a hydrogen atom, an alkyl group of 1 to 6 carbon atoms of an hydroxylalkyl group of 2 to 6 carbon atoms. Alkanolamines which are especially preferred are compounds of the formula:

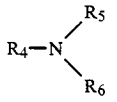

wherein $R_4$ is an hydroxyalkyl group of 2 to 4 carbon atoms and each of $R_5$ and $R_6$ is an alkyl group to 1 to 4 carbon atoms or an hydroxyalkyl group of 2 to 4 carbon atoms. Typical examples of alkanolamines which can be used in the color developing compositions of this invention include:

ethanolamine
diethanolamine
triethanolamine
di-isopropanolamine
2-methylaminoethanol
2-ethylaminoethanol
2-dimethylaminoethanol
2-diethylaminoethanol
1-diethylamino-2-propanol
3-diethylamino-1-propanol
3-dimethylamino-1-propanol
isopropylaminoethanol
3-amino-1-propanol
2-amino-2-methyl-1,3-propanediol
ethylenediamine tetraisopropanol
benzyldiethanolamine
2-amino-2-(hydroxymethyl)-1,3-propanediol
and the like.

To improve the clarity of the working developing solution and reduce the tendency for tarring to take place, it is preferred to incorporate therein a small amount of water-soluble sulfonated polystyrene. The sulfonated polystyrene can be used in the free acid form or in the salt form. The free acid form of the sulfonated polystyrene is comprised of units having the formula:

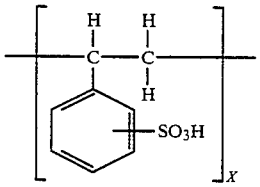

where X is an integer representing the number of repeating units in the polymer chain and is typically in the range from about 10 to about 3,000 and more preferably in the range from about 100 to about 1,000.

The salt form of the sulfonated polystyrene is comprised of units having the formula:

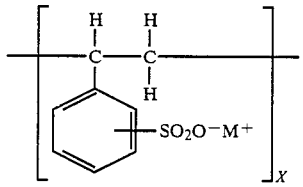

where X is as defined above and M is a monovalent cation, such as, for example, an alkali metal ion.

The sulfonated polystyrenes utilized in the developing compositions of this invention can be substituted with substituents such as halogen atoms, hydroxy groups, and alkyl groups. For example, they can be sulfonated derivatives of chlorostyrene, alpha methyl styrene, vinyl toluene, and the like. Neither the molecular weight nor the degree of sulfonation are critical, except that the molecular weight should not be so high nor the degree of sulfonation so low as to render the sulfonated polystyrene insoluble in aqueous alkaline photographic color developing solutions. Typically, the average degree of sulfonation, that is the number of sulfonic acid groups per repeating styrene unit, is in the range from about 0.5 to 4 and more preferably in the range from about 1 to about 2.5. A variety of salts of the sulfonated polystyrene can be employed, including, in addition to alkali metal salts, the amine salts such as salts of monoethanolamine, diethanolamine, triethanolamine, morpholine, pyridine, picoline, quinoline, and the like.

The sulfonated polystyrene can be used in the working developer solution in any effective amount. Typically, it is employed in amount of from about 0.05 to about 30 grams per liter of developer solution, more usually in amount of from about 0.1 to about 15 grams per liter, and preferably in amounts of from about 0.2 to about 5 grams per liter.

In addition to or in place of the aminopolycarboxylic acid sequestering agent, the photographic color developing compositions of this invention can contain an aminopolyphosphonic acid sequestering agent. The aminopolyphosphonic acid sequestering agent can be utilized in the form of a free acid or in the form of a water-soluble salt. Among the useful aminopolyphosphonic acid sequestering agents are the following:

(1) amino-N,N-dimethylenephosphonic acids of the formula:

$$R^3—N(CH_2PO_3M_2)_2$$

wherein M is a hydrogen atom or a monovalent cation and $R^3$ is an alkyl group, an aryl group, an aralkyl group, an alkaryl group, an alicyclic group or a heterocyclic radical, and $R^3$ can be further substituted with substituents such as hydroxyl, halogen, an alkoxy group, a $—PO_3M_2$ group, a $—CH_2PO_3M_2$ group, or an $—N(CH_2PO_3M_2)_2$ group:

(2) aminodiphosphonic acids of the formula:

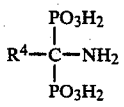

in which $R^4$ is an alkyl group, preferably of one to five carbon atoms, and (3) N-acylaminodiphosphonic acids of the formula:

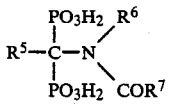

where $R^5$, $R^6$ and $R^7$ are hydrogen or an alkyl group, preferably alkyl of one to five carbon atoms.

Typical examples of the aminopolyphosphonic acid sequestering agents useful in the novel color developing compositions of this invention include:

1-aminoethane-1,1-diphosphonic acid,
1-aminopropane-1,1-diphosphonic acid,
N-acetyl-1-aminoethane-1,1-diphosphonic acid,
ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyanilino-N,N-dimethylenephosphonic acid,
propylamino-N,N-dimethylenephosphonic acid,
4-(N-pyrrolidino)butylamine-N,N-bis(methylene phosphonic acid,
1,3-diaminopropanol-N,N,N',N'-tetramethylenephosphonic acid,
1,3-propanediamine-N,N,N',N'-tetramethylenephosphonic acid,
1,6-hexanediamine-N,N,N',N'-tetramethylenephosphonic acid,
o-acetamidobenzylamino-N,N-dimethylenephosphonic acid,
o-toluidine-N,N-dimethylenephosphonic acid,
2-pyridylamino-N',N'-dimethylenephosphonic acid,
diethylenetriamine pentamethylenephosphonic acid,
and the like.

Other particularly useful sequestering agents for photographic color developing compositions are the hydroxyalkylidenediphosphonic acid sequestering agents of the formula:

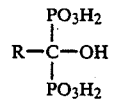

where R is alkyl of 1 to 5 carbon atoms.

The hydroxyalkylidenediphosphonic acid sequestering agents can serve as both the sequestering agent which functions to sequester iron and the sequestering agent which functions to sequester calcium, as they have the ability to effectively sequester both iron and calcium. As described in Brown, U.S. Pat. No. 3,839,045 issued Oct. 1, 1974, they are preferably utilized in combination with small amounts of lithium salts, such as lithium sulfate.

Additional ingredients which can optionally be included in the photographic color developing compositions of this invention include thickening agents, brightening agents, wetting agents, stain reducing agents, and so forth.

The photographic color developing compositions of this invention are preferably free, or at least substantially free, of bromides. By the term "substantially free" is meant a concentration of bromide of not more than about 0.01 moles per mole of primary aromatic amino color developing agent. As is well known, bromides are very active development restrainers. To achieve the objective of a very short development time, it is necessary to have little or no bromide in the developing solution. Where the emulsions used are all-chloride emulsions, then there will not be any bromide present in the developing solution as a result of leaching from the element. As previously explained herein, high chloride silver halide elements are elements in which the silver halide grains are at least 80 mole percent silver chloride. Thus, while high chloride silver halide elements can contain small amounts of silver bromide or silver bromoidodide, the amounts are low enough that the concentration of bromide in the developing solution that results from leaching is low, and the restraining effect is not pronounced.

Chloride will, of course, be leached from high chloride silver halide elements, but chloride is not nearly as active a development restrainer as bromide. An important objective of the preferred embodiments of this invention is to have minimal development restraint from either developing composition components or from seasoning products that leach from the photographic element. Thus, while the working solution may contain chloride that has leached from the element, typically no chloride is incorporated in the replenisher solution.

It is particularly preferred that the photographic color developing compositions of this invention be free of benzyl alcohol. In the past, benzyl alcohol has typically been used in the processing of color print papers to function as a coupling accelerator. Since the developing compositions of this invention are designed to have minimal development restraint—and since oxidation protection is provided by use of an N,N-dialkylhydroxylamine, optionally with the additional use of a small amount of sulfite, and therefore without introducing significant competition with coupler for oxidized developing agent—they do not require the use of benzyl alcohol. Elimination of benzyl alcohol has several benefits. For example, it provides improved mixability of the developing composition components and it provides the environmental improvement of reduced biological oxygen demand. A further advantage is that for those processes in which a bleach-fix is utilized, the elimination of benzyl alcohol from the developer enables the pH of the bleach-fix to be reduced without the risk of producing leuco cyan dye. The reduced pH increases the rate of bleach-fix reactions, and thereby allows a very short bleach-fix time and, accordingly, facilitates accomplishment of the goal of a very short total processing time. Yet another advantage of eliminating benzyl alcohol from the color developing composition is that this will help in avoiding or minimizing edge straining of the photographic print, as described for example in Tamagawa et al, U.S. Pat. No. 4,433,030, issued Feb. 21, 1984.

In the production of color photographic images, it is necessary to remove the silver image which is formed coincident with the dye image. This can be done by oxidizing the silver by means of a suitable oxidizing agent, commonly referred to as a bleaching agent, in the presence of halide ion followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

Color print papers are most commonly processed by use of a bleach-fixing solution. The bleaching agent is typically a ferric complex of an aminopolycarboxylic acid, most usually the ferric complex of ethylenediaminetetraacetic acid (EDTA). The fixing agent is typically a thiosulfate such as sodium thiosulfate or ammonium thiosulfate.

In processing color print papers, the bleach-fixing step can be followed by a stabilizing step in which the print is processed in a stabilizing bath to reduce fading of the dye images and staining of the print that can result from exposure to high humidities and/or high temperatures. The stabilizing bath will typically contain an aldehyde, such as formaldehyde, which is known to react with the active methylene groups on residual color-forming couplers, and thus prevent them from reacting with the image dyes. In addition to the aldehyde, the stabilizing bath can contain a variety of other agents such as sequestering agents, buffering agents, and biocides. Particularly effective stabilizing baths for use in the process of this invention are desired in Mowrey, U.S. Pat. No. 3,676,136, issued July 11, 1972.

The novel color developing compositions of this invention are especially useful in the processing of color print papers utilizing high chloride silver halide emulsion layers and particularly in the processing of such papers in a rapid access process comprising the steps of color developing, bleach-fixing without a wash step between the steps of color developing and bleach-fixing, and stabilizing without a wash step between the steps of bleach-fixing and stabilizing. The bleach-fixing composition is comprised of a thiosulfate fixing agent and a ferric complex of an aminopolycarboxylic acid, which acts as a bleaching agent, while the stabilizing composition contains a aldehyde as the stabilizing agent. Such a process involves only the three steps of color developing, bleach-fixing and stabilizing—followed by a short drying step—so it is especially well adapted to the very short total processing time that is needed in so-called "mini-lab" processing facilities. The wash steps are omitted in the interest of achieving the shortest possible total processing time and reducing the total amount of effluent.

In a particularly preferred embodiment, the present invention provides a method of rapid access processing of a high chloride silver halide photographic color print paper, which comprises the steps of:

(1) developing for a period of about 30 to about 60 seconds at a temperature of about 30 ° to about 40° C. in a color developing composition having a pH in the range of from about 9 to about 13 and comprising (a) a primary aromatic amino color developing agent, (b) an N,N-dialkylhydroxylamine, (c) at least one sequestering agent which functions to sequester iron, and (d) at least one sequestering agent which functions to sequester calcium.

(2) bleach-fixing, without washing between the developing and bleach-fixing steps, for a period of about 30 to about 60 seconds at a temperature of about 25° C. to about 40° C. in a bleach-fix composition having a pH in the range of from about 5 to about 8 and more preferably in the range of from about 6 to about 7 and comprising a thiosulfate fixing agent and a bleaching agent which is a ferric complex of an aminopolycarboxylic acid; and (3) stabilizing, without washing between the bleach-fixing and stabilizing steps, for a period of about 60 to about 120 seconds at a temperature of about 25° to about 40° C. in a stabilizing composition having a pH in the range from about 5 to about 8 and comprising an aldehyde that functions as a stabilizing agent.

Following completion of the stabilizing step, the print is dried for a brief period. Drying for about one minute at a temperature of about 60° C. is usually adequate.

Since, in the preferred process of this invention, no washing steps are utilized, there is carry-over of bleach-fixing composition into the stabilizing bath. The thiosulfate which is thereby carried into the stabilizing bath can undergo sulfurization. However, the tendency for sulfurization to occur can be eliminated, or at least reduced, by use of a stabilizing bath containing an aldehyde bisulfite adduct, such as those described in Mowrey, U.S. Pat. No. 3,676,136. In addition to the aldehyde bisulfite adduct, the stabilizing bath advantageously comprises an aminopolycarboxylic acid sequestering agent, of the type hereinbefore described, and an aminopolyphosphonic acid sequestering agent or hydroxyalkylidenediphosphonic acid sequestering agent of the types hereinbefore described. The aminopolycarboxylic acid sequesters calcium, and thereby prevents the formation of unwanted precipitates, and also protects the sulfite against oxidation. The aminopolyphosphonic acid or hydroxyalkylidenediphosphonic acid sequesters heavy metals, such as copper and iron, and thereby prevents such metals from catalyzing the oxidation of sulfite. It also provides protection against yellowing of photographic prints caused by retained iron. Another useful ingredient in a stabilizing bath of this type is a biocide. Examples of particularly useful biocides are thiazoles such as 2-methyl-4-isothiazolin-3-one and 5-chloro-2-methyl-4-isothiazolin-3-one.

The individual ingredients employed in the photographic color developing compositions of this invention have been employed heretofore in one or other of the photographic color developing compositions described in the United States patents listed hereinabove. However, the particular combination of ingredients utilized in the color developing compositions of this invention is a novel combination, and is unexpectedly advantageous in providing a developing composition which is especially adapted for use with high chloride silver halide elements, and is particularly well adapted for use in the rapid access process described herein in which total wet processing time is as little as three minutes.

It should be particularly noted that 5,6-dihydroxy-1,2,4-benzenetrisulfonic acid has not been employed heretofore in photographic color developing compositions, and that its use (in either acid or salt form) represents an important feature of the most preferred embodiment of the present invention. As compared with similar compounds which have previously been used in color developing compositions—such as the 4,5-dihydroxy-m-benzenedisulfonic acid described in U.S. Pat. No. 3,746,544—it provides several important advantages. Thus, for example, it has improved stability in alkaline solutions and is more stable to aerial oxidation. Moreover, it has much less of a tendency to exert adverse sensitometric effects.

It should also be noted that the N,N-dialkylhydroxylamine is utilized in the developing composition of this invention as an anti-oxidant. This is in contrast with its typical use in the prior art, for example, in U.S. Pat. No. 3,489,566, in which it is used primarily as a balancing developing agent, that is as an agent which reacts with exposed silver halide so as to function as an auxiliary developing agent.

In U.S. Pat. Nos. 4,170,478 and 4,264,716, the hydroxylamines which are used in the color developing compositions described are hydroxylamines of the formula:

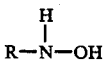

where R is hydrogen or alkyl, and water-soluble acid salts thereof. Thus, the hydroxylamines in these patents are unsubstituted hydroxylamines or monoalkyl-substituted hydroxylamines. In the present invention, dialkyl-substituted hydroxylamines are utilized rather than unsubstituted hydroxylamines or mono-alkyl-substituted hydroxylamines. The dialkylsubstituted hydroxylamines have been unexpectedly found to provide satisfactory protection against oxidation, while having the advantage that they do not reduce oxidized developer before it can react to form dye, and the further advantage that they are much slower developing agents than unsubstituted hydroxylamines or mono-alkyl-substituted hydroxylamines. Thus, by using the dialkyl-substituted hydroxylamine and no sulfite, or a very low level of sulfite, competition with couplers in the dye-forming reactions is effectively avoided.

The invention is further illustrated by the following example of its practice:

A photographic color print paper of the high chloride type, as described in Atwell, U.S. Pat. No. 4,269,927 issued May 26, 1981, was processed in a three-step process consisting of a 45 second development step, a 45 second bleach-fix step and a 90 second stabilization step. Each of the three steps was carried out at a temperature of 35° C. and the print was dried for one minute at 60° C. No washing steps were used in the process. The developing composition exhibited excellent stability and the process provided excellent results, even though the total wet time was only three minutes, and thus achieved the objective of high quality rapid-access processing, which is especially useful in a "mini-lab" facility. The color developing, bleach-fixing and stabilizing compositions used in the process were as follows:

| Color Developing Composition | | |
|---|---|---|
| Component | Working Solution | Replenisher Solution |
| Lithium salt of sulfonated polystyrene(1) | 0.25 mL/L | 0.25 mL/L |
| Triethanolamine | 11.0 mL/L | 11.0 mL/L |
| N,N—diethylhydroxylamine(2) | 6.0 mL/L | 8.0 mL/L |
| Potassium sulfite(3) | 0.5 mL/L | 0.5 mL/L |
| Color developing agent(4) | 5.0 g/L | 7.3 g/L |
| Stain reducing agent(5) | 2.3 g/L | 3.0 g/L |
| Potassium chloride | 2.3 g/L | 0 |
| EDTA (2Na · $H_2O$) | 3.0 g/L | 3.0 g/L |
| 3,4-dihydroxy-1,2,5-benzenetrisulfonic acid trisodium salt | 0.6 g/L | 0.6 g/L |
| Potassium Carbonate | 25.0 g/L | 25.0 g/L |
| pH | 10.04 | 10.40 |

(1)30% by weight aqueous solution.
(2)85% by weight aqueous solution.
(3)45% by weight aqueous solution.
(4)4-(N—ethyl-N—2-methanesulfonylaminoethyl)-2-methylphenylene-diamineses-quisulfate monohydrate.
(5)A stilbene compound available under the trademark KODAK EKTAPRINT 2 Stain-Reducing Agent from Eastman Kodak Company.

BLEACH-FIXING COMPOSITION

The bleach-fixing composition had a pH of 6.2 and was comprised of ammonium thiosulfate, sodium bisulfite, and an ammonium salt of the ferric complex of ethylenediaminetetraacetic acid.

STABILIZING COMPOSITION

The stabilizing composition had a pH of 7.2 and was comprised of formaldehyde, sodium metabisulfite, potassium hydroxide, diethylene glycol, 5-chloro-2-methyl-4-isothiazolin-3-one, the disodium salt of ethylenediaminetetraacetic acid, and 1-hydroxyethylidene-1,1-diphosphonic acid. (In this formulation, the diethylene glycol serves as a solvent for the 5-chloro-2-methyl-4-isothiazolin-3-one).

An important feature of this invention is that there is minimal development restraint and this permits rapid access processing. Moreover, the rapid access processing does not require high development temperatures and can be achieved with development temperatures of as low as about 15° C.

The invention has been described in detail with particular reference to preferred embodiments thereof, but it will be understood that variations and modifications can be effected within the spirit and scope of the invention.

What is claimed is:

1. A photographic color developing composition which is especially useful in the development of high chloride silver halide photographic elements, said composition being substantially free of bromides and comprising:

(1) a primary aromatic amino color developing agent,
(2) N,N-diethylhydroxylamine,
(3) at least one sequestering agent which functions to sequester iron,
(4) at least one sequestering agent which functions to sequester calcium, and (5) from zero to 0.2 moles of sulfite per mole of said primary aromatic amino color developing agent.

2. A photographic color developing composition as claimed in claim 1 wherein said sequestering agent which functions to sequester iron is an aromatic polyhydroxy compound that forms a complex with ferric ion in alkaline solution in which the molar ratio of the ferric ion to the aromatic polyhydroxy compound is 1 to 3, and said sequestering agent which functions to sequester calcium is an aminopolycarboxylic acid sequestering agent.

3. A photographic color developing composition as claimed in claim 1 wherein an hydroxylalkylidenediphosphonic acid sequestering agent is employed as both the sequestering agent which functions to sequester iron and the sequestering agent which functions to sequester calcium.

4. A photographic color developing composition which is especially useful in the development of high chloride silver halide photographic elements, said composition being substantially free of bromides and benzyl alcohol and comprising:

(1) a primary aromatic amino color developing agent,
(2) N,N-diethylhydroxylamine,
(3) an aromatic polyhydroxy compound that forms a complex with ferric ion in alkaline solution in which the molar ratio of the ferric ion to the aromatic polyhydroxy compound is 1 to 3,
(4) at least one aminopolycarboxylic acid sequestering agent,
(5) at least one pH buffering agent, and
(6) from zero to 0.2 moles of sulfite per mole of said primary aromatic amino color developing agent.

5. A photographic color developing composition as claimed in claim 1 additionally comprising an alkanolamine.

6. A photographic color developing composition as claimed in claim 1 additionally comprising triethanolamine.

7. A photographic color developing composition as claimed in claim 1 additionally comprising a water-soluble sulfonated polystyrene.

8. A photographic color developing composition as claimed in claim 4, additionally comprising triethanolamine and a water-soluble sulfonated polystyrene.

9. A photographic color developing composition as claimed in claim 1 wherein the primary aromatic amino color developing agent is 4-(N-ethyl-N-2-methanesulfonylaminoethyl)-2-methylphenylenediamine sesquisulfate monohydrate.

10. A photographic color developing composition as claimed in claim 4 wherein said aromatic polyhydroxy compound has the formula:

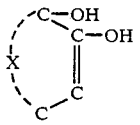

where X represents the carbon atoms necessary to complete a benzene or naphthalene aromatic ring structure.

11. A photographic color developing composition as claimed in claim 4 wherein said aromatic polyhydroxy compound is 5,6-dihydroxy-1,2,4-benzenetrisulfonic acid trisodium salt.

12. A photographic color developing composition as claimed in claim 4 wherein said aminopolycarboxylic acid sequestering agent is ethylenediaminetetraacetic acid.

13. A photographic color developing composition which is especially useful for the development of high chloride silver halide photographic elements, said composition being substantially free of bromides and benzyl alcohol and comprising:

(1) 4-(N-ethyl-N-2-methanesulfonylaminoethyl)-2-methylphenylenediamine sesquisulfate monohydrate,
(2) N,N-diethylhydroxylamine,
(3) 5,6-dihydroxy-1,2,4-benzenetrisulfonic acid trisodium salt,
(4) the disodium salt of ethylenediaminetetraacetic acid,
(5) the lithium salt of sulfonated polystyrene,
(6) triethanolamine,
(7) potassium sulfite in an amount of up to 0.2 moles per mole of 4-(N-ethyl-N-2-methanesulfonylaminoethyl)-2-methylphenylenediamine sesquisulfate monohydrate, and
(8) potassium carbonate.

14. A method of rapid access processing of a high chloride silver halide photographic color element, said method comprising the steps of:

(1) developing said element for a period of about 30 to about 60 seconds at a temperature of about 30° C. to about 40° C. in a color developing composition having a pH in the range of from about 9 to about 13, said color developing composition being substantially free of bromides and comprising:
(a) a primary aromatic amino color developing agent,
(b) N,N-diethylhydroxylamine,
(c) at least one sequestering agent which functions to sequester iron,
(d) at least one sequestering agent which functions to sequester calcium, and
(e) from zero to 0.2 moles of sulfite per mole of said primary aromatic amino color developing agent;
(2) bleach-fixing said element, without washing between the developing and bleach-fixing steps, for a period of about 30 to about 60 seconds at a temperature of about 25° C. to about 40° C. in a bleach-fix composition having a pH in the range of from about 5 to about 8 and comprising a thiosulfate fixing agent and a ferric complex of an aminopolycarboxylic acid that functions as a bleaching agent; and
(3) stabilizing said element, without washing between the bleach-fixing and stabilizing steps, for a period of about 60 to about 120 seconds at a temperature of from about 25° C. to about 40° C. in a stabilizing composition having a pH in the range of from about 5 to about 8 and comprising an aldehyde that functions as a stabilizing agent.

15. A method as claimed in claim 14 wherein said sequestering agent which functions to sequester iron is an aromatic polyhydroxy compound that forms a complex with ferric ion in alkaline solution in which the molar ratio of the ferric ion to the aromatic polyhydroxy compound is 1 to 3 and said sequestering agent which functions to sequester calcium is an aminopolycarboxylic acid sequestering agent.

16. A method as claimed in claim 14 wherein an hydroxyalkylidenediphosphonic acid sequestering agent is employed as both the sequestering agent which functions to sequester iron and the sequestering agent which functions to sequester calcium.

17. A method of rapid access processing of a high chloride silver halide photographic color element, said method comprising the steps of:

(1) developing said element for a period of about 30 to about 60 seconds at a temperature of about 30° C. to about 40° C. in a color developing composition having a pH in the range of from about 9 to about 13, said color developing composition being substantially free of bromides and benzyl alcohol and comprising:
  (1) a primary aromatic amino color developing agent,
  (2) N,N-diethylhydroxylamine,
  (3) an aromatic polyhydroxy compound that forms a complex with ferric ion in alkaline solution in which the molar ratio of the ferric ion to the aromatic polyhydroxy compound is 1 to 3,
  (4) at least one aminopolycarboxylic acid sequestering agent,
  (5) at least one pH buffering agent, and
  (6) from zero to 0.2 moles of sulfite per mole of said primary aromatic amino color developing agent;

(2) bleach-fixing said element, without washing between the developing and bleach-fixing steps, for a period of about 30 to about 60 seconds at a temperature of about 25° C. to about 40° C. in a bleach-fix composition having a pH in the range of from about 5 to about 8 and comprising a thiosulfate fixing agent and a ferric complex of an aminopolycarboxylic acid that functions as a bleaching agent; and (3) stabilizing said element, without washing between the bleach-fixing and stabilizing steps, for a period of about 60 to about 120 seconds at a temperature of from about 25° C. to about 40° C. in a stabilizing composition having a pH in the range of from about 5 to about 8 and comprising an aldehyde that functions as a stabilizing agent.

18. A method as claimed in claim 17, wherein said color developing composition additionally comprises an alkanolamine.

19. A method as claimed in claim 17, wherein said color developing composition additionally comprises triethanolamine and a water-soluble sulfonated polystyrene.

20. A method as claimed in claim 17, wherein said aromatic polyhydroxy compound is 5,6-dihydroxy-1,2,4-benzenetrisulfonic acid trisodium salt.

21. A method as claimed in claim 17, wherein said bleach-fixing composition has a pH in the range of from about 6 to about 7.

22. A method as claimed in claim 17, wherein said stabilizing composition comprises an aldehyde bisulfite adduct.

23. A method as claimed in claim 17, wherein said stabilizing composition comprises a thiazole compound which functions as a biocide.

24. A method as claimed in claim 17, wherein said stabilizing composition comprises an aminopolycarboxylic acid sequestering agent, and a member selected from the group consisting of aminopolyphosphonic acid sequestering agents and hydroxyalkylidene diphosphonic acid sequestering agents.

25. A method of rapid access processing of a high chloride silver halide photographic color paper, said method comprising the steps of:

(1) developing said color paper for a period of about 45 seconds at a temperature of about 35° C. in a color developing composition having a pH of about 10, said color developing composition being substantially free of bromides and benzyl alcohol and comprising:
  (a) 4-(N-ethyl-N-2-methanesulfonylaminoethyl)-2-methylphenylenediamine sesquisulfate monohydrate,
  (b) N,N-diethylhydroxylamine,
  (c) 5,6-dihydroxy-1,2,4-benzenetrisulfonic acid trisodium salt,
  (d) the disodium salt of ethylenediaminetetraacetic acid,
  (e) the lithium salt of sulfonated polystyrene,
  (f) triethanolamine,
  (g) potassium sulfite in an amount of up to 0.2 moles per mole of 4-(N-ethyl-N-2-methanesulfonylaminoethyl)-2-methylphenylenediamine sesquisulfate monohydrate, and
  (h) potassium carbonate;

(2) bleach-fixing said color paper, without washing between the developing and bleach-fixing steps, for a period of about 45 seconds at a temperature of about 35° C. in a bleach-fix composition having a pH of about 6 and comprising ammonium thiosulfate and the ammonium salt of a ferric complex of ethylenediaminetetraacetic acid; and (3) stabilizing said color paper, without washing between the bleach-fixing and stabilizing steps, for a period of about 90 seconds at a temperature of about 35° C. in a stabilizing composition having a pH of about 7 and comprising formaldehyde, sodium metabisulfite, potassium hydroxide, diethylene glycol, 5-chloro-2-methyl-4-isothiazolin-3-one, the disodium salt of ethylenediaminetetraacetic acid, and 1-hydroxyethylidene-1,1-diphosphonic acid.

* * * * *